US005882010A

United States Patent [19]

Geror

[11] Patent Number: 5,882,010

[45] Date of Patent: Mar. 16, 1999

[54] GAME WITH RINGS AND TARGET

[76] Inventor: Lyle M. Geror, 2933 Kissing Rock, Lowell, Mich. 49331

[21] Appl. No.: 984,965

[22] Filed: Dec. 4, 1997

[51] Int. Cl.[6] ..... A63B 67/06

[52] U.S. Cl. ..... 273/400

[58] Field of Search ..... 273/336, 337, 273/338, 339, 398, 399, 400, 401, 402

[56] References Cited

U.S. PATENT DOCUMENTS 4,169,596 10/1979 Chinenson ..... 273/401
4,392,653 7/1983 Blume, Sr. ..... 273/400

*Primary Examiner*—William H. Grieb

*Attorney, Agent, or Firm*—Waters & Morse, P.C.

[57] ABSTRACT

A game having a target and a projectile that is tossed or pitched to the target. The target has a bottom, has a cup generally centered on the bottom, and perimeter sidewalls that are spaced outward from the cup and surround the bottom. The projectile is a disk member that has indicia disposed thereupon to distinguish the projectile from other projectiles. The target may optionally include an anchor to anchor the target to a surface. Further, the projectile may be a washer that is enclosed in a protective layer. The protective layer may define the distinguishing indicia. The sidewalls may also be constructed as hollow walls, having inner and outer portions. The hollow may optionally be filled with a filler material.

12 Claims, 2 Drawing Sheets

GAME WITH RINGS AND TARGET

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to games. More particularly, the invention relates to horse shoes, ring toss, and such games in which a player tosses or pitches a projectile toward a target to obtain a score of points, according to the proximity of the projectile to the target.

These types of games are attractive at various gatherings, including picnics and outings to a park or a beach, for example. They provide extended periods of friendly competition and socializing. They also commonly require bulky apparatus or apparatus that is permanently installed or other vise installed with some difficulty prior to play, however, such as a horse shoe court, for example. Thus, one will appreciate a game that uses relatively compact, easily stored, and easily transported apparatus, and that is easily set up and played in many settings, with virtually no limitations.

BRIEF SUMMARY OF THE INVENTION

Accordingly, the invention provides a game having a target and a projectile that is tossed or pitched to the target. The target has a generally centered cup with a base and upstanding sidewalls. Perimeter target sidewalls are spaced outward from the cup sidewalls. A tray portion extends between the cup sidewalls and the perimeter target sidewalls. The projectile is a generally circular disk member, and has indicia disposed thereupon to distinguish the projectile from other projectiles.

In one aspect of the invention, the target includes an anchor to anchor the target to a surface. Further, the projectile may be a washer that is enclosed in a protective layer. The protective layer may define the distinguishing indicia. The sidewalls may also be constructed as hollow walls, having inner and outer portions. A filler material may optionally be disposed in the hollow void.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
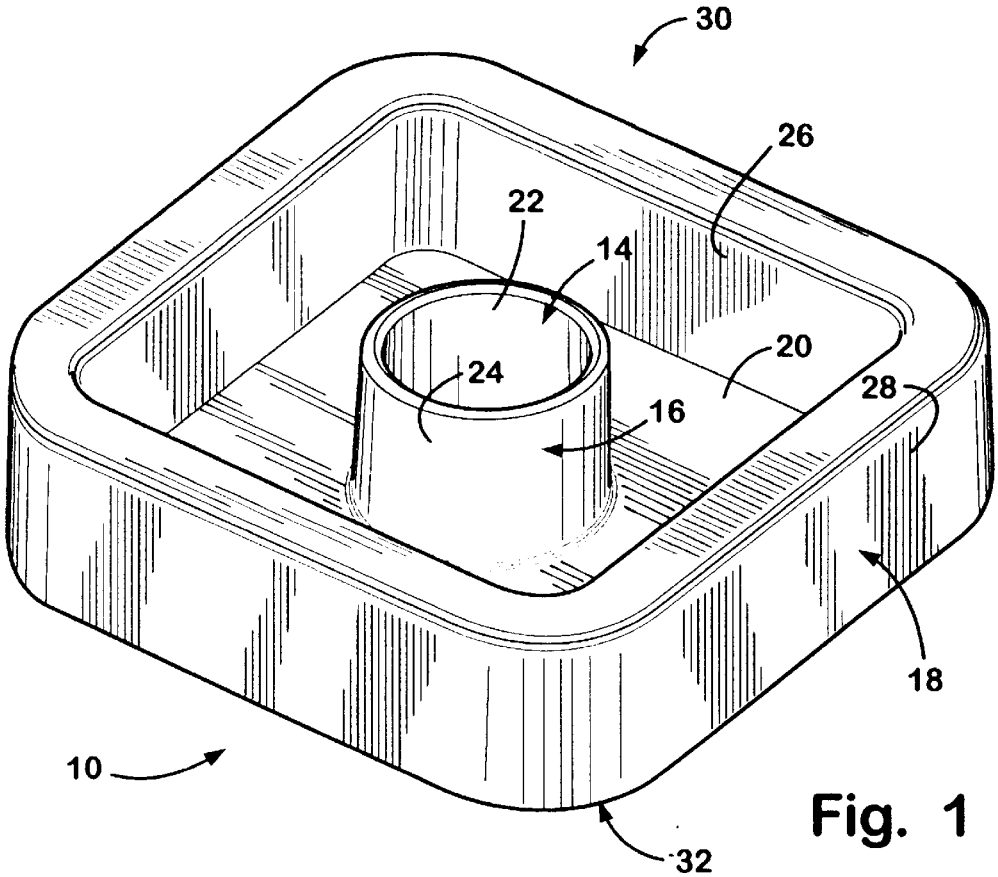
FIG. 1 is a top, perspective view of a target according to the invention.

A game according to the invention, has a target, generally referenced in the drawing figures by the number 10, and a number of disk projectiles, generally referenced in the drawing figures by the number 12. More particularly, target 10 is a generally square member, as shown, that has a generally centered cup 14 with sidewalls 16, having target perimeter sidewalls 18 spaced apart from the cup sidewalls, and having a tray or bottom portion 20 extending between the cup sidewalls and the perimeter target sidewalls.

Target 10 is conveniently constructed as an integral, one piece plastic molding. Any suitable, durable material may be used to construct target 10, such as thermoplastic olefin (TPO), for example. One having ordinary skill in the art will realize that a suitable material will have an energy absorbing quality because of the nature of the game, with disks 12 being tossed into or at the target 10.

The cup sidewalls 16 are preferably hollow, with inner and outer portions, 22 and 24, respectively. Similarly, the perimeter target sidewalls 18 are also preferably hollow, with inner and outer portions, 26 and 28, respectively, and a bight portion or rim interconnecting the inner and outer portions. Thus, the sidewalls 16 and 18 define a generally open target top 30, as well as an opposing, generally open bottom 32.

To enhance impact resistance and to deaden rebound, the tray or bottom portion 20 of the target 10 is preferably raised from and does not contact a supporting surface. Further, the generally open bottom 32 may optionally be filled with an impact absorbing material, such as a plastic foam, for example, as is generally known by one having ordinary skill in the art. Of course, the preferred construction of plastic molding target 10 is not the only suitable construction for the target, which may also be constructed out of solid materials, including, and not limited to, wood, plastics, and metals.

In another option, the target 10 may be also be provided with anchors 36 to facilitate affixing the target to a surface. As shown in phantom, a set of four counter sunk holes through the tray portion 20 may be optionally provided as anchors 36, for use with flat head screws, nails, spikes, or other fasteners, depending upon the surface material to which the target 10 may be fastened.

For each game set, six projectiles or disks 12 are provided. The projectiles 12 are common, metal flat washers, having an inside diameter of about one inch (25.4 mm). The washers are provided with distinguishing indicia, so players can tell them apart. More specifically, disks 12 are preferably encased in a protective layer 38. Injection molding a layer of thermoplastic to encase the washer has been found to perform satisfactorily, as will be understood by one having ordinary skill in the art. Various coloring agents may be added to the protective layer 38 to provide the washers 12 with distinguishing indicia, as will also be understood by one having ordinary skill in the art.

Figure 2:
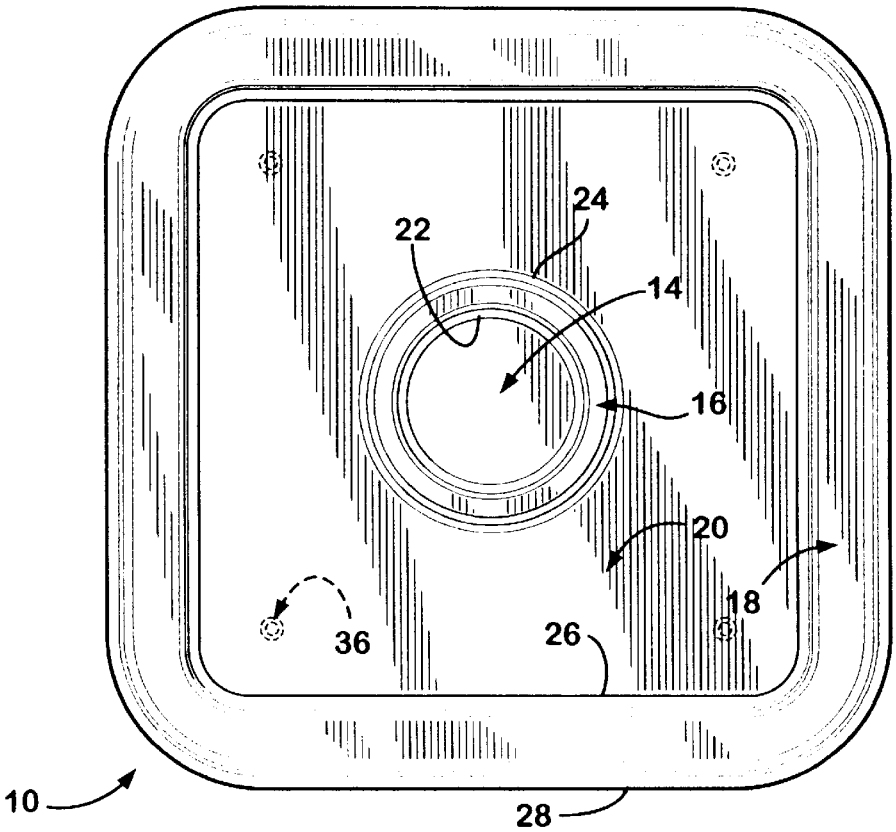
FIG. 2 is a top, plan view thereof.
Figure 3:
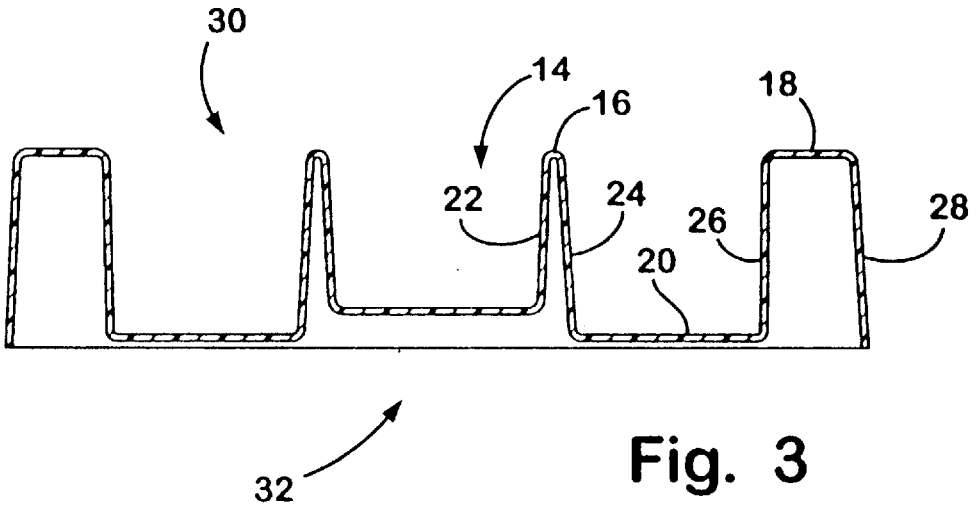
FIG. 3 is a cross-sectional view along line III—III of FIG. 2.
Figure 4:
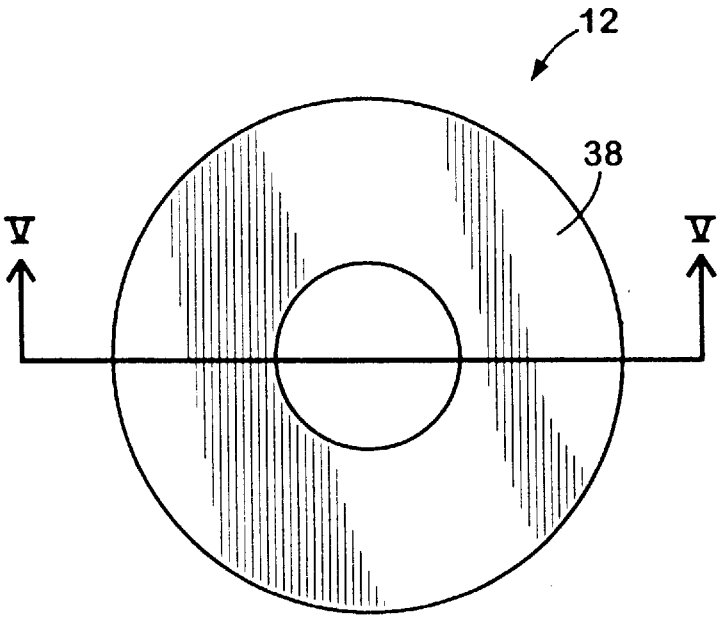
FIG. 4 is a top, plan view of a projectile according to the invention.
Figure 5:
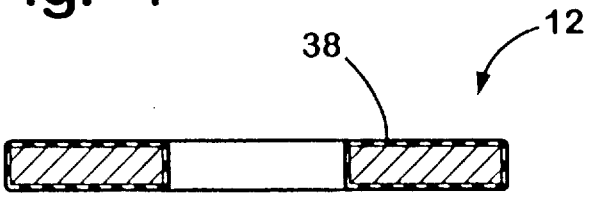
FIG. 5 is a cross-sectional view along line IV—IV of FIG. 4.

As seen in FIGS. 2 and 4, the radius of curvature of the inside corners between adjacent target perimeter walls 18 is less than the radius of curvature of the outer edge of the projectile 12, to help keep the projectile inside the target 10. Further, the inner portion 26 of the target perimeter walls 18 is substantially perpendicular to the tray portion or bottom 20 to help keep the projectile 12 within the target 10. Those who are familiar with molding technology will appreciate that a certain amount of draft is required in a mold for release of the molded part. Thus, the inner portion 26 of the target perimeter walls 18 may be other than absolutely perpendicular to the tray portion 20, having an about one degree or less draft angle to accommodate release of the molded target 10 from its mold, while minimizing any tendency for a projectile 12 to "climb" out of the target.

In use, two targets 10 will be placed on the ground, a floor, or some other, preselected, supporting surface, a predetermined distance apart, about 30 feet (9144 mm), for example. Two players will stand at one target 10 and toss or pitch the disks 12 to the other target 10. Each player will preferably use three disks 21, distinguishable by the indicia disposed thereupon. Play will preferably alternate between each of the two players, with each player tossing one disk 12 at a time for his turn. After each player has had three turns, using all three disks 12, a score is determined according to the relative positions of each disk to the target 10. A disk 12 in the center cup 14 may score five points, while a disk in the tray portion 20 may score three points, a disk that leans against the outer portion 28 of the target perimeter walls 18 may score two points, and a disk within 1 foot of the target may score one point. The first player to score exactly twenty-one points may be declared the winner. Points scored in excess of twenty-one points may be required to be subtracted from the player's existing score, however. The game may be played with teams of players, and it may also be played using only one target 10, with each player taking a turn at a predetermined position relative to the target. In short, one will readily realize that many variations of the rules, or form, of the game may be accommodated.

It will be understood by one having ordinary skill in the art and by those who practice the invention, that various modifications and improvements may be made without departing from the spirit of the disclosed concept. Various relational terms, including left, right, front, back, top, and bottom, for example, if used, are used in the claims only to convey relative positioning of various elements of the claimed invention. The scope of protection afforded is to be determined by the claims and by the breadth of interpretation allowed by law.

I claim:

1. Apparatus for playing a game, comprising:

a target that is adapted to be placed upon a support surface, the target having a generally centered cup with a cup bottom and upstanding cup inner and outer sidewalls, having perimeter target inner and outer sidewalls spaced outward from the cup, and having a bottom portion extending between the cup outer sidewall and the perimeter target inner sidewall, the cup sidewalls generally having an inverted V cross-sectional configuration with the inner cup sidewall extending generally upward from the cup bottom to a junction with the outer cup sidewall that extends generally downward at least as far as the inner cup sidewall to the bottom portion, the perimeter target sidewalls generally having an inverted U cross-sectional configuration with the inner perimeter target sidewall extending generally upward from the bottom portion to a bight portion that extends generally horizontally outward to the outer perimeter target sidewall that extends generally downward farther than the inner perimeter target sidewall so the bottom portion and the cup bottom are spaced from the supporting surface; and a projectile, the projectile being a generally circular disk and having indicia disposed thereupon to distinguish the projectile from other projectiles.

2. The apparatus defined in claim 1, wherein a first hollow is defined between the inner and outer cup sidewalls and a second hollow is defined between the inner and outer perimeter target sidewalls, and wherein one of the first and second hollows is filled with an impact absorbing filler material.

3. The apparatus defined in claim 1, wherein the target includes an anchor to affix the target to a surface.

4. The apparatus defined in claim 1, wherein the projectile is enclosed by a protective layer.

5. The apparatus defined in claim 4, wherein the protective layer defines the distinguishing indicia.

6. The apparatus defined in claim 4, wherein the protective layer is colored to define the distinguishing indicia.

7. Apparatus for playing a game, comprising:

a target constructed of a moldable material and adapted to be placed upon a support surface, the target having a cup bottom, having a cup inner sidewall that extends generally upward and slightly outward, a first distance, from the cup bottom to an upper edge, having a cup outer sidewall that extends generally downward and slightly outward, a second distance, from the cup inner sidewall upper edge to a lower edge, the second distance being at least as far as the first distance, the cup inner and outer sidewalls being generally spaced apart and defining a space between them, having a tray extending radially outward from the cup outer sidewall lower edge to a perimeter edge, having an inner perimeter sidewall surrounding the tray and extending generally upward and slightly outward, a third distance, from the tray to an upper edge, having a rim extending radially outward from the inner perimeter sidewall upper edge, having an outer perimeter sidewall that extends generally downward and slightly outward, a fourth distance, from the rim, the fourth distance being farther than the third distance, so the outer perimeter sidewall engages the support surface and the cup bottom and tray are spaced from the support surface, the inner and outer perimeter sidewalls being spaced apart and defining a space between them; and a disk having indicia disposed thereupon to distinguish the disk from other disks.

8. The apparatus defined in claim 7, wherein a first hollow is defined between the cup inner and outer sidewalls and a second hollow is defined between the inner and outer perimeter sidewalls, and wherein one of the first and second hollows is filled with an impact absorbing filler material.

9. The apparatus defined in claim 7, wherein the box further has an anchor to affix the box to a surface.

10. The apparatus defined in claim 7, wherein the disk is enclosed by a protective layer.

11. The apparatus defined in claim 10, wherein the protective layer defines the distinguishing indicia.

12. The apparatus defined in claim 10, wherein the protective layer is colored to define the distinguishing indicia.

* * * * *

UNITED STATES PATENT AND TRADEMARK OFFICE

CERTIFICATE OF CORRECTION

PATENT NO : 5,882,010

DATED : March 16, 1999

INVENTOR(S): Lyle M. Geror

It is certified that error appears in the above-identified patent and that said Letters Patent are hereby corrected as shown below Column 1, lines 21-22, "other vise" should be "otherwise".

Signed and Sealed this

Twenty-first Day of September, 1999

*Attest:*

Q. TODD DICKINSON

*Attesting Officer*

*Acting Commissioner of Patents and Trademarks*